US012497229B2

(12) United States Patent
Sollie

(10) Patent No.: US 12,497,229 B2
(45) Date of Patent: Dec. 16, 2025

(54) PACKAGING ASSEMBLY

(71) Applicant: Pratt Corrugated Holdings, Inc., Brookhaven, GA (US)

(72) Inventor: Greg Sollie, Sharpsburg, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

(21) Appl. No.: 18/425,552

(22) Filed: Jan. 29, 2024

(65) Prior Publication Data

US 2025/0242991 A1 Jul. 31, 2025

(51) Int. Cl.

| | |
|---|---|
| ***B65D 81/38*** | (2006.01) |
| ***B65D 25/04*** | (2006.01) |
| ***B65D 25/14*** | (2006.01) |

(52) U.S. Cl.

CPC ..... *B65D 81/3823* (2013.01); *B65D 25/04* (2013.01); *B65D 25/14* (2013.01); *B65D 81/3858* (2013.01); *B65D 81/386* (2013.01)

(58) Field of Classification Search

CPC .. B65D 81/05; B65D 81/386; B65D 81/3853; B65D 77/26; B65D 5/58; B65D 5/0281; B65D 5/48014; B65D 5/4266; B65D 5/48048; B65D 5/5033; B65D 5/5026; B65D 5/5045; B65D 5/244

See application file for complete search history.

(56) References Cited

U.S. PATENT DOCUMENTS

| | | | | |
|---|---|---|---|---|
| 736,955 A | | 8/1903 | Garman | |
| 975,121 A | | 11/1910 | Carter | |
| 1,344,147 A | | 6/1920 | Potter | |
| 1,691,736 A | * | 11/1928 | Oppenheim | B65D 5/5035 229/117.27 |
| 1,720,016 A | | 7/1929 | Tinsley | |

(Continued)

FOREIGN PATENT DOCUMENTS

| | | |
|---|---|---|
| DE | 202010012264 | 12/2010 |
| DE | 202015002945 | 4/2016 |

(Continued)

OTHER PUBLICATIONS

Marsh, et al.; Article entitled: "Food Packaging—Roles, Materials, and Environmental Issues", Journal of Food Science 72.3 (2008): R39-R55, 17 pgs.

(Continued)

*Primary Examiner* — Mollie Impink

(74) *Attorney, Agent, or Firm* — Taylor Duma LLP

(57) ABSTRACT

A packaging assembly includes an outer box including a first main panel connected to a second main panel, a third main panel connected to the second main panel, and a fourth main panel connected to the third main panel, the fourth main panel connected to the first main panel; an insert, an insert connected to at least two of the main panels of the outer box, the insert including a first main panel connected to a second main panel; a third main panel connected to the second main panel; and a fourth main panel connected to the first main panel and the third main panel, wherein at least one support formation is arranged between at two of the four main panels, wherein each support formation connects the insert to the outer box.

23 Claims, 12 Drawing Sheets

(56) References Cited

U.S. PATENT DOCUMENTS 1,795,613 A * 3/1931 Moehle ..... B65D 5/5045 40/539
1,813,787 A 7/1931 Webster
2,031,254 A 2/1936 Derr
2,084,296 A 6/1937 Eustis
2,173,871 A * 9/1939 Zalkind ..... B65D 5/58 229/199
2,231,982 A * 2/1941 Zalkind ..... B65D 5/505 220/592.2
2,260,181 A * 10/1941 Hollingsworth ..... B65D 85/64 206/326
2,326,817 A 8/1943 Zalkind
2,332,287 A * 10/1943 Zalkind ..... B65D 85/78 229/122.33
2,496,731 A 2/1950 Longo
2,553,418 A 5/1951 Loth
2,648,487 A 8/1953 Linda
2,735,607 A 2/1956 Wasyluka
2,786,622 A 3/1957 Ross et al.
2,808,977 A 10/1957 Mccormick
2,927,720 A 3/1960 Adams
3,075,683 A 1/1963 Grossman et al.
3,114,493 A 12/1963 Dunkin
3,175,753 A 3/1965 Civitello
3,245,602 A 4/1966 Bovard
3,248,040 A 4/1966 Friedman
3,279,677 A 10/1966 Wojcik
3,362,610 A 1/1968 Van Dyke
3,647,134 A 3/1972 Carnevalino
3,883,065 A * 5/1975 Presnick ..... B65D 5/58 220/666
3,982,682 A * 9/1976 Fremion ..... B65D 5/5033 206/521
D247,952 S 5/1978 Donaldson
4,171,745 A 10/1979 Zicko
4,254,173 A 3/1981 Peer, Jr.
4,257,550 A 3/1981 Frohlicher
4,331,231 A 5/1982 Boyle
4,550,441 A 10/1985 Keppel
4,806,398 A 2/1989 Martin, Jr.
4,826,011 A 5/1989 Jud
4,874,620 A 10/1989 Mendenhall et al.
5,055,161 A 10/1991 Hoffman
5,056,665 A 10/1991 Boecker et al.
5,075,152 A 12/1991 Tsukuda et al.
5,126,519 A 6/1992 Peleg
5,283,118 A 2/1994 Murakami et al.
5,335,846 A 8/1994 Smith et al.
5,388,701 A 2/1995 Ridgeway
5,399,366 A 3/1995 Geddes et al.
5,492,410 A 2/1996 Cocozza
5,579,917 A 12/1996 Lofgren
5,690,853 A 11/1997 Jackson et al.
5,723,223 A 3/1998 Quick
5,775,576 A 7/1998 Stone
RE35,875 E 8/1998 Shuert
6,092,654 A 7/2000 Webb
6,311,843 B1 11/2001 Smith et al.
6,405,873 B2 6/2002 Koike
6,471,826 B2 10/2002 Glover et al.
D466,409 S 12/2002 Wood
6,513,703 B2 2/2003 Becker
6,517,243 B2 2/2003 Huffer et al.
6,761,793 B2 7/2004 Murano
6,780,269 B2 8/2004 Kobayashi et al.
6,971,539 B1 * 12/2005 Abbe ..... B65D 25/54 220/592.12
7,021,524 B1 4/2006 Becker et al.
7,229,677 B2 6/2007 Miller
7,278,249 B2 10/2007 Kari
7,452,316 B2 11/2008 Cals et al.
7,753,209 B2 7/2010 McDonald et al.
7,862,688 B2 1/2011 Thomas
7,935,410 B2 5/2011 Orologio
7,935,411 B2 5/2011 Orologio
8,221,871 B2 7/2012 Orologio
8,256,616 B2 9/2012 Eilert
8,308,900 B2 11/2012 Covarrubias et al.
8,327,601 B2 12/2012 Orologio
8,343,614 B2 1/2013 Orologio
8,763,811 B2 7/2014 Lantz
8,851,362 B2 10/2014 Aksan et al.
8,936,847 B2 1/2015 Orologio
9,015,895 B2 4/2015 Filho et al.
9,114,593 B2 8/2015 Orologio
9,138,968 B2 9/2015 Shi et al.
9,238,523 B1 1/2016 Frost
9,284,088 B2 3/2016 Humphries et al.
9,345,316 B2 5/2016 Filho et al.
9,345,379 B2 5/2016 Filho et al.
9,474,361 B2 10/2016 Filho et al.
9,492,050 B2 11/2016 Filho et al.
9,511,899 B1 12/2016 Valentini et al.
D782,763 S 3/2017 Xavier et al.
D782,764 S 3/2017 Xavier et al.
D790,788 S 6/2017 Xavier et al.
9,682,795 B1 6/2017 Frost
D792,041 S 7/2017 Xavier et al.
D792,762 S 7/2017 Meneaud
D793,229 S 8/2017 Meneaud
9,815,585 B2 11/2017 Gasior et al.
9,888,764 B2 2/2018 Xavier et al.
9,908,663 B1 3/2018 Valentini et al.
9,924,790 B2 3/2018 Xavier et al.
9,932,162 B2 4/2018 Stack, Jr.
9,981,797 B2 5/2018 Aksan et al.
10,035,638 B1 7/2018 Leroy
10,106,290 B2 10/2018 Couture
10,196,170 B2 2/2019 Gasior
10,358,283 B2 7/2019 Lutzig
10,583,977 B2 3/2020 Collison et al.
D881,011 S 4/2020 Wolf
10,625,488 B2 4/2020 Alef et al.
10,696,450 B2 6/2020 Valentini et al.
10,843,840 B2 11/2020 Sollie et al.
10,870,529 B2 12/2020 Khatchaturian et al.
10,882,682 B2 1/2021 Collison et al.
D919,432 S 5/2021 Muse et al.
11,072,148 B2 7/2021 Yializis et al.
11,078,010 B2 8/2021 Bellamah et al.
11,085,688 B2 8/2021 Seo et al.
11,214,427 B2 1/2022 Collison et al.
11,267,645 B2 3/2022 Bellamah et al.
11,312,563 B2 4/2022 Smith
11,338,985 B2 5/2022 Henderson et al.
11,383,878 B2 7/2022 Frost
11,427,391 B2 8/2022 Comerford
11,634,265 B2 4/2023 Collison et al.
D988,862 S 6/2023 Turner
11,780,666 B2 10/2023 Collison et al.
11,958,777 B2 4/2024 Schabel, Jr. et al.
D1,042,111 S 9/2024 Zhu
12,252,310 B2 3/2025 Sollie et al.
12,264,006 B1 4/2025 Ott et al.
12,304,706 B2 5/2025 Sollie et al.
D1,083,588 S 7/2025 Ott et al.
12,441,508 B2 10/2025 Sollie et al.
12,448,171 B2 10/2025 Sollie et al.
2004/0004111 A1 * 1/2004 Cardinale ..... B65D 5/0227 229/117.32
2004/0038050 A1 2/2004 Saijo et al.
2004/0101215 A1 5/2004 Sellmeier et al.
2005/0173425 A1 8/2005 Wnek et al.
2005/0221104 A1 10/2005 Ortolani et al.
2006/0045392 A1 3/2006 Bannister et al.
2006/0070699 A1 4/2006 Sparks et al.
2006/0105124 A1 5/2006 Kikuchi
2006/0169753 A1 8/2006 Piucci et al.
2006/0213803 A1 9/2006 Saitou et al.
2006/0222796 A1 10/2006 Morris
2007/0010386 A1 1/2007 Champ et al.
2007/0110932 A1 5/2007 Castillo et al.

(56) References Cited

U.S. PATENT DOCUMENTS

| | | | | |
|---|---|---|---|---|
| 2007/0215681 | A1* | 9/2007 | Johnson | B65D 81/3823 229/120.36 |
| 2007/0243396 | A1 | 10/2007 | Buchbinder et al. | |
| 2008/0121681 | A1 | 5/2008 | Wiedmeyer | |
| 2009/0022434 | A1 | 1/2009 | Chiba et al. | |
| 2010/0285266 | A1 | 11/2010 | Korte | |
| 2011/0042449 | A1 | 2/2011 | Copenhaver et al. | |
| 2011/0048996 | A1 | 3/2011 | Klaus et al. | |
| 2011/0100868 | A1* | 5/2011 | Lantz | B65D 81/3853 206/584 |
| 2011/0123137 | A1 | 5/2011 | Smith et al. | |
| 2011/0143070 | A1 | 6/2011 | Toft et al. | |
| 2011/0158562 | A1 | 6/2011 | Desilets et al. | |
| 2011/0192852 | A1 | 8/2011 | Chebli | |
| 2011/0236664 | A1 | 9/2011 | Ortolani et al. | |
| 2011/0253773 | A1 | 10/2011 | Lozier | |
| 2012/0015145 | A1 | 1/2012 | Depres | |
| 2012/0100320 | A1 | 4/2012 | Toft et al. | |
| 2012/0106877 | A1 | 5/2012 | Tang | |
| 2012/0117921 | A1 | 5/2012 | Toft et al. | |
| 2012/0171453 | A1 | 7/2012 | Rochat et al. | |
| 2012/0207954 | A1 | 8/2012 | Dalpe et al. | |
| 2013/0122268 | A1 | 5/2013 | Reilly et al. | |
| 2015/0158656 | A1 | 6/2015 | Mckinnon | |
| 2015/0344182 | A1 | 12/2015 | Malin | |
| 2016/0376084 | A1 | 12/2016 | Wein et al. | |
| 2017/0001781 | A1 | 1/2017 | Cojocaru et al. | |
| 2017/0043565 | A1 | 2/2017 | Fushimi et al. | |
| 2017/0066582 | A1* | 3/2017 | Vogel | B65D 81/3834 |
| 2017/0151765 | A1 | 6/2017 | Öhman | |
| 2017/0166361 | A1 | 6/2017 | Shirosawa et al. | |
| 2017/0313045 | A1 | 11/2017 | Braghini | |
| 2017/0327298 | A1 | 11/2017 | Morasse et al. | |
| 2018/0022499 | A1 | 1/2018 | Sridhar et al. | |
| 2018/0148246 | A1 | 5/2018 | Fu et al. | |
| 2018/0178965 | A1 | 6/2018 | Tsai et al. | |
| 2018/0208387 | A1 | 7/2018 | Cantrell et al. | |
| 2018/0265274 | A1 | 9/2018 | Damarell et al. | |
| 2018/0290813 | A1 | 10/2018 | Waltermire et al. | |
| 2018/0290815 | A1 | 10/2018 | Waltermire et al. | |
| 2018/0298168 | A1 | 10/2018 | Nummila-Pakarinen et al. | |
| 2018/0311940 | A1 | 11/2018 | Toft et al. | |
| 2018/0327171 | A1 | 11/2018 | Waltermire et al. | |
| 2019/0126599 | A1 | 5/2019 | Sargeant et al. | |
| 2019/0210324 | A1 | 7/2019 | Yializis et al. | |
| 2019/0315553 | A1 | 10/2019 | Fiflis et al. | |
| 2019/0359407 | A1 | 11/2019 | Kale et al. | |
| 2020/0115135 | A1 | 4/2020 | Li et al. | |
| 2020/0148409 | A1 | 5/2020 | Sollie et al. | |
| 2020/0148453 | A1 | 5/2020 | Sollie et al. | |
| 2020/0189256 | A1 | 6/2020 | Field et al. | |
| 2020/0262636 | A1 | 8/2020 | Wiemann et al. | |
| 2020/0283959 | A1 | 9/2020 | Flynn et al. | |
| 2020/0331653 | A1 | 10/2020 | Dejesus | |
| 2020/0346816 | A1 | 11/2020 | Sollie et al. | |
| 2021/0130075 | A1 | 5/2021 | Long | |
| 2021/0139200 | A1 | 5/2021 | O'Hara et al. | |
| 2021/0347553 | A1 | 11/2021 | Sollie et al. | |
| 2021/0371152 | A1 | 12/2021 | Lopez Crespo | |
| 2022/0002070 | A1 | 1/2022 | Moghaddas et al. | |
| 2022/0119149 | A1 | 4/2022 | Comerford | |
| 2022/0135308 | A1 | 5/2022 | Wetsch | |
| 2022/0169435 | A1 | 6/2022 | Wiemann et al. | |
| 2022/0185563 | A1 | 6/2022 | Fu et al. | |
| 2022/0194678 | A1 | 6/2022 | Kilmer | |
| 2022/0250827 | A1 | 8/2022 | Smith | |
| 2022/0289450 | A1 | 9/2022 | Bollinger et al. | |
| 2022/0388759 | A1 | 12/2022 | Patel et al. | |
| 2023/0079525 | A1 | 3/2023 | Tuano et al. | |
| 2023/0365304 | A1 | 11/2023 | Kaminaga et al. | |
| 2024/0140643 | A1 | 5/2024 | Takahashi | |
| 2024/0253848 | A1 | 8/2024 | Sollie et al. | |
| 2024/0253849 | A1 | 8/2024 | Sollie et al. | |
| 2024/0253853 | A1 | 8/2024 | Sollie et al. | |
| 2024/0253854 | A1 | 8/2024 | Sollie et al. | |
| 2024/0317481 | A1 | 9/2024 | Sollie et al. | |
| 2025/0115390 | A1 | 4/2025 | Sollie et al. | |
| 2025/0197089 | A1 | 6/2025 | Sollie et al. | |
| 2025/0197090 | A1 | 6/2025 | Sollie et al. | |
| 2025/0197091 | A1 | 6/2025 | Sollie et al. | |
| 2025/0197092 | A1 | 6/2025 | Sollie et al. | |
| 2025/0206514 | A1 | 6/2025 | Ott et al. | |

FOREIGN PATENT DOCUMENTS

| | | |
|---|---|---|
| EP | 3398877 | 11/2018 |
| EP | 3708026 | 9/2020 |
| FR | 2656591 | 7/1991 |
| GB | 580826 | 9/1946 |
| GB | 2218406 | 11/1989 |
| GB | 2540389 | 1/2017 |
| JP | D1713371 | 4/2022 |
| KR | 20210089477 | 7/2021 |
| KR | 102420062 | 7/2022 |
| KR | 301248487 | 2/2024 |
| WO | 2014006279 | 1/2014 |
| WO | 2014071377 | 5/2014 |
| WO | 2018220132 | 12/2018 |
| WO | 2025165790 | 8/2025 |

OTHER PUBLICATIONS

Rahman, et al.; Handbook of Food Preservation, Second Edition, Springer, London, 2012. pp. 211-250, 1088 pgs.

Risch, Sara J.; Article entitled: "Food Packaging History and Innovations", Journal of Agricultural and Food Chemistry 57.18 (2009), 8089-8092, 4 pgs.

Verghese, et al.; "Packaging for Sustainability", Springer, London, 2012. 211-250, 389 pgs.

Custom Packaging Co., Ltd; Article entitled: "Cardboard Insulated Boxes", located at <https://www.boxpackingsolution.com/insulated-boxes/>, Copyright 1998-2023, 9 pgs.

Nice Packs; Article entitled: "Insulated Shipping Boxes", located at <https://www.shopnicepacks.com/products/ insulated-shipping-box>, Copyright 2023, 17 pgs.

Sorbafreeze; Article entitled: "Chilltek Ecotek Box", located at <https://www.sorbafreeze.com/product/ecotek-insulated-corrugated-box/>, Copyright 2023, 7 pgs.

Starlight Packaging; Article entitled: "Environmentally Friendly Insulated Cool Box", located at <https://starlightpackaging.co.uk/boxes/environmentally-friendly-insulated-cool-box/>, Copyright 2023, 7 pgs.

The Print Daddy; Article entitled: "Cardboard Box Dividers and Partitions", located at <https://theprintingdaddy.com/cardboard-box-dividers-and-partitions>, Copyright 2021, 6 pgs.

Sollie, Greg; Non-Final Office Action for U.S. Appl. No. 18/386,187, filed Nov. 1, 2023, mailed Oct. 1, 2024, 31 pgs.

Sollie, Greg; Requirement for Restriction/Election for U.S. Appl. No. 18/386,187, filed Nov. 1, 2023, mailed Aug. 12, 2024, 9 pgs.

Sollie, Greg; Non-Final Office Action for U.S. Appl. No. 18/222,272, filed Jul. 14, 2023, mailed Aug. 22, 2024, 55 pgs.

Sollie, Greg; Non-Final Office Action for U.S. Appl. No. 18/222,284, filed Jul. 14, 2023, mailed Aug. 29, 2024, 31 pgs.

Sollie, Greg; Non-Final Office Action for U.S. Appl. No. 18/222,293, filed Jul. 14, 2023, mailed Oct. 11, 2024, 36 pgs.

Sollie, Greg; Requirement for Restriction/Election for U.S. Appl. No. 18/222,293, filed Jul. 14, 2023, mailed Jul. 26, 2024, 6 pgs.

Sollie, Greg; Non-Final Office Action for U.S. Appl. No. 18/222,298, filed Jul. 14, 2023, mailed Aug. 15, 2024, 31 pgs.

Ott, Paul; Non-Final Office Action for U.S. Appl. No. 18/393,116, filed Dec. 21, 2023, mailed Aug. 9, 2024, 27 pgs.

Jones Family of Companies I Cold Chain Packaging; "Jones Sustainable Packaging". Date first available: May 29, 2023. Site visited: Jul. 29, 2024. Available online: https://jonesfamilyco.com/cold-chain-packaging (Year: 2023), 3 pgs.

Ott, Paul; Applicant-Initiated Interview Summary for U.S. Appl. No. 29/923,155, filed Dec. 28, 2023, mailed Oct. 2, 2024, 3 pgs.

Ott, Paul; Non-Final Office Action for U.S. Appl. No. 29/923, 155, filed Dec. 28, 2023, mailed Aug. 16, 2024, 26 pgs.

(56) References Cited

OTHER PUBLICATIONS

Supplyone Sunrise; Large Styrofoam Cooler I MrBoxOnline. Date first available: Sep. 27, 2013. Site visited: Jul. 29, 2024. Available online: https://www.mrboxonline.com/15375x95x105-quart-large-styrofoam-coolers-p-2118.html (Year: 2013), 4 pgs.
ULINE; Insulated Box Liners—12 ×12 ×6" S-18278. Date first available: Mar. 20, 2015. Site visited: Jul. 29, 2024. Available online: https://www.uline.com/ProducUDetail/S-18278/Insulated-Shippers-and-Supplies/Insulated-Box-Liners-12-x-12-x-6 (Year: 2015), 1 pg.
Sollie, Greg; Final Office Action for U.S. Appl. No. 18/222,298, filed Jul. 14, 2023, mailed Jan. 2, 2025, 24 pgs.
Ott, Paul; Applicant-Initiated Interview Summary for U.S. Appl. No. 18/393,116, filed Dec. 21, 2023, mailed Dec. 27, 2024, 2 pgs.
Sollie, Greg; Final Office Action for U.S. Appl. No. 18/222,272, filed Jul. 14, 2023, mailed Dec. 20, 2024, 47 pgs.
Sollie, Greg; Notice of Allowance for U.S. Appl. No. 18/222,293, filed Jul. 14, 2023, mailed Dec. 19, 2024, 5 pgs.
Ott, Paul; Notice of Allowance for U.S. Appl. No. 18/393,116, filed Dec. 21, 2023, mailed Dec. 10, 2024, 14 pgs.
Ott, Paul; Final Office Action for U.S. Appl. No. 29/923,155, filed Dec. 28, 2023, mailed Dec. 4, 2024, 20 pgs.
Sollie, Greg; Notice of Allowance for U.S. Appl. No. 18/222,284, filed Jul. 14, 2023, mailed Nov. 4, 2024, 14 pgs.
Sollie, Greg; Final Office Action for U.S. Appl. No. 18/386,187, filed Nov. 1, 2023, mailed Jan. 24, 2025, 20 pgs.
Sollie, Greg; Applicant-Initiated Interview Summary for U.S. Appl. No. 18/386,187, filed Nov. 1, 2023, mailed Feb. 26, 2025, 3 pgs.
Sollie, Greg; Non-Final Office Action for U.S. Appl. No. 18/386,187, filed Nov. 1, 2023, mailed Apr. 16, 2025, 21 pgs.
Sollie, Greg; Requirement for Restriction/Election for U.S. Appl. No. 19/070,809, filed Mar. 5, 2025, mailed Apr. 25, 2025, 5 pgs.
Sollie, Greg; Advisory Action for U.S. Appl. No. 18/222,272, filed Jul. 14, 2023, mailed Mar. 14, 2025, 3 pgs.
Sollie, Greg; Non-Final Office Action for U.S. Appl. No. 18/222,272, filed Jul. 14, 2023, mailed Apr. 3, 2025, 74 pgs.
Sollie, Greg; Non-Final Office Action for U.S. Appl. No. 18/986,285, filed Dec. 18, 2024, mailed Feb. 25, 2025, 35 pgs.
Sollie, Greg; Non-Final Office Action for U.S. Appl. No. 18/222,298, filed Jul. 14, 2023, mailed Feb. 28, 2025, 19 pgs.
Ott, Paul; Non-Final Office Action for U.S. Appl. No. 19/079,307, filed Mar. 13, 2025, mailed Apr. 18, 2025, 9 pgs.
Sollie, Greg; International Search Report and Written Opinion for PCT Application No. PCT/US2025/013461, filed Jan. 28, 2025, mailed Mar. 26, 2025, 10 pgs.
Ott, Paul; Notice of Allowance for U.S. Appl. No. 29/923,155, filed Dec. 28, 2023, mailed Mar. 3, 2025, 14 pgs.
Sollie, Greg; Applicant-Initiated Interview Summary for U.S. Appl. No. 18/386,187, filed Nov. 1, 2023, mailed May 19, 2025, 2 pgs.
Sollie, Greg; Applicant-Initiated Interview Summary for U.S. Appl. No. 18/386,187, filed Nov. 1, 2023, mailed Aug. 1, 2025, 2 pgs.
Sollie, Greg; Non-Final Office Action for U.S. Appl. No. 19/070,793, filed Mar. 5, 2025, mailed May 21, 2025, 19 pgs.
Sollie, Greg; Non-Final Office Action for U.S. Appl. No. 19/070,799, filed Mar. 5, 2025, mailed Jun. 5, 2025, 25 pgs.
Sollie, Greg; Non-Final Office Action for U.S. Appl. No. 19/070,803, filed Mar. 5, 2025, mailed May 22, 2025, 15 pgs.
Sollie, Greg; Non-Final Office Action for U.S. Appl. No. 19/070,809, filed Mar. 5, 2025, mailed Jul. 2, 2025, 13 pgs.
Sollie, Greg; Final Office Action for U.S. Appl. No. 18/222,272, filed Jul. 14, 2023, mailed Jul. 30, 2025, 83 pgs.
Sollie, Greg; Notice of Allowance for U.S. Appl. No. 18/986,285, filed Dec. 18, 2024, mailed Jun. 24, 2025, 16 pgs.
Sollie, Greg; Notice of Allowance for U.S. Appl. No. 18/222,298, filed Jul. 14, 2023, mailed Jun. 11, 2025, 5 pgs.
Ott, Paul; Notice of Allowance for U.S. Appl. No. 19/079,307, filed Mar. 13, 2025, mailed Jul. 29, 2025, 9 pgs.
Sollie, Greg; Examination Report for Australian Application No. 2024203860, filed Jun. 6, 2024, mailed May 30, 2025, 10 pgs.
Sollie, Greg; Examination Report for Australian Patent Application No. 2024203861, filed Jun. 6, 2024, mailed May 30, 2025, 10 pgs.
Sollie, Greg; Examination Report for Australian Patent Application No. 2024203862, filed Jun. 6, 2024, mailed May 30, 2025, 11 pgs.
Sollie, Greg; Examination Report for Australian Patent Application No. 2024203863, filed Jun. 6, 2024, mailed May 30, 2025, 10 pgs.
Sollie, Greg; Final Office Action for U.S. Appl. No. 19/070,793, filed Mar. 5, 2025, mailed Oct. 1, 2025, 24 pgs.
Sollie, Greg; Final Office Action for U.S. Appl. No. 19/070,799, filed Mar. 5, 2025, mailed Oct. 1, 2025, 22 pgs.
Sollie, Greg; Final Office Action for U.S. Appl. No. 19/070,803, filed Mar. 5, 2025, mailed Oct. 7, 2025, 24 pgs.
Sollie, Greg; Examination Report No.2 for Australian Application No. 2024203860, filed Jun. 6, 2024, mailed Sep. 12, 2025, 5 pgs.
Olympia-Tile—4' x 4'—Vulcanized Rubber Gym Tile. Date first available: Oct. 23, 2021. Site visited: Jul. 21, 2025. Available online: https://amarcoproducts.com/products/sport-weight-room-flooring/rubber-gym-tile/ot-48-vulcanized-rubber-gym-tile (Year: 2021).
Ott, Paul; Corrected Notice of Allowance for Design U.S. Appl. No. 30/010,324, filed Jun. 26, 2025, mailed Oct. 20, 2025, 12 pgs.
Ott, Paul; Notice of Allowance for Design U.S. Appl. No. 30/010,324, filed Jun. 26, 2025, mailed Aug. 5, 2025, 10 pgs.
Pratt Retail Specialties 22 in. x 43 ft. Rafter Corrugated Attic Baffle. Date first available: Jan. 23, 2025. Site visited: Jul. 21, 2025. Available online: https://www.homedepot.com/p/Pratt-Retail-Special ties-22-in-x-43-ft-Rafter-Corrugated-Attic-Baffle-Pack-of-50-22x43AB50P/333011583 (Year: 2025).
Sollie, Greg; Non-Final Office Action for U.S. Appl. No. 18/386,187, filed Nov. 1, 2023, mailed Oct. 27, 2025, 29 pgs.
Sollie, Greg; Final Office Action for U.S. Appl. No. 19/070,809, filed Mar. 5, 2025, mailed Oct. 28, 2025, 17 pgs.

* cited by examiner

PACKAGING ASSEMBLY

REFERENCE TO RELATED APPLICATIONS

This application references U.S. patent application Ser. No. 18/222,272, filed Jul. 14, 2023, which claims the benefit of U.S. Provisional Application Nos. 63/441,946, filed Jan. 30, 2023, 63/447,380, filed Feb. 22, 2023, and 63/466,836, filed May 16, 2023, each of which is hereby specifically incorporated by reference herein in its entirety. This application also references U.S. patent application Ser. No. 17/834,999, filed Jun. 8, 2022, (issued as U.S. Pat. No. 11,780,666 on Oct. 10, 2023), which is a continuation application of U.S. patent application Ser. No. 17/502,599, filed Oct. 15, 2021 (issued as U.S. Pat. No. 11,634,265 on Apr. 25, 2023), which is a continuation of U.S. patent application Ser. No. 17/123,673, filed Dec. 16, 2020 (issued as U.S. Pat. No. 11,214,427 on Jan. 4, 2022), which is a continuation application of U.S. patent application Ser. No. 16/414,309, filed May 16, 2019 (issued as U.S. Pat. No. 10,882,682 on Jan. 5, 2021), which is a divisional application of U.S. patent application Ser. No. 15/677,738, filed Aug. 15, 2017 (issued as U.S. Pat. No. 10,583,977 on Mar. 10, 2020), which claims the benefit of U.S. Provisional Application Nos. 62/375,555, filed on Aug. 16, 2016, 62/419,894, filed on Nov. 9, 2016, and 62/437,365, filed on Dec. 21, 2016. This application also references U.S. patent application Ser. No. 18/393,116, filed Dec. 21, 2023. The entire disclosure of each of the above applications is incorporated herein by reference in its entirety.

TECHNICAL FIELD

This disclosure relates to packaging. More specifically, this disclosure relates to insulated packaging.

BACKGROUND

In various aspects, packaging elements can be in need of insulation. Isolating contents from the outside can be challenging. In particular, systems that can be arranged to address some insulation challenges can be difficult to produce, requiring multiple steps to assemble any packaging elements.

SUMMARY

A packaging assembly includes an outer box, the outer box including a first main panel connected to a second main panel, a third main panel connected to the second main panel, and a fourth main panel connected to the third main panel, the fourth main panel connected to the first main panel; an insert, an insert connected to at least two of the main panels of the outer box, the insert including a first main panel connected to a second main panel; a third main panel connected to the second main panel; and a fourth main panel connected to the first main panel and the third main panel, wherein at least one support formation is arranged between at two of the four main panels, wherein each support formation connects the insert to the outer box.

A method of arranging a packaging assembly in an expanded state includes obtaining a collapsed packaging assembly, the collapsed packaging assembly including a blank for forming an outer box, the blank comprising a first main panel, a second main panel connected to the first main panel, a third main panel connected to the second main panel, and a fourth main panel connected to the third main panel; an insert connected to the second main panel and the third main panel of the blank, the insert including a first main panel connected to a first support formation; a second main panel connected to the first support formation; a third main panel connected to the second main panel; a second support formation connected to the third main panel; a fourth main panel connected to the support formation; and the fourth main panel connected to the first main panel; bending the first main panel of the blank with respect to the second main panel of the blank; bending the second main panel of the blank with respect to the third main panel of the blank; bending the third main panel of the blank with respect to the fourth main panel of the blank; connecting the fourth main panel of the blank to the first main panel of the blank such that the insert arranges within a box defined by formation of the blank.

A packaging assembly includes an outer box, the outer box including a first main panel connected to a second main panel, a third main panel connected to the second main panel, and a fourth main panel connected to the third main panel, the fourth main panel connected to the first main panel; an insert arranged within the outer box and defining at least one gap between the insert and the outer box, the insert including a first main panel connected to a second main panel; a third main panel connected to the second main panel; and a fourth main panel connected to the first main panel and the third main panel, wherein at least one support formation is arranged between at two of the four main panels, wherein each support formation connects the insert to the outer box.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a packaging assembly and associated methods, systems, devices, and various apparatus. It would be understood by one of skill in the art that the disclosed packaging assembly is described in but a few exemplary embodiments among many. No particular terminology or description should be considered limiting on the disclosure or the scope of any claims issuing therefrom.

Figure 1:
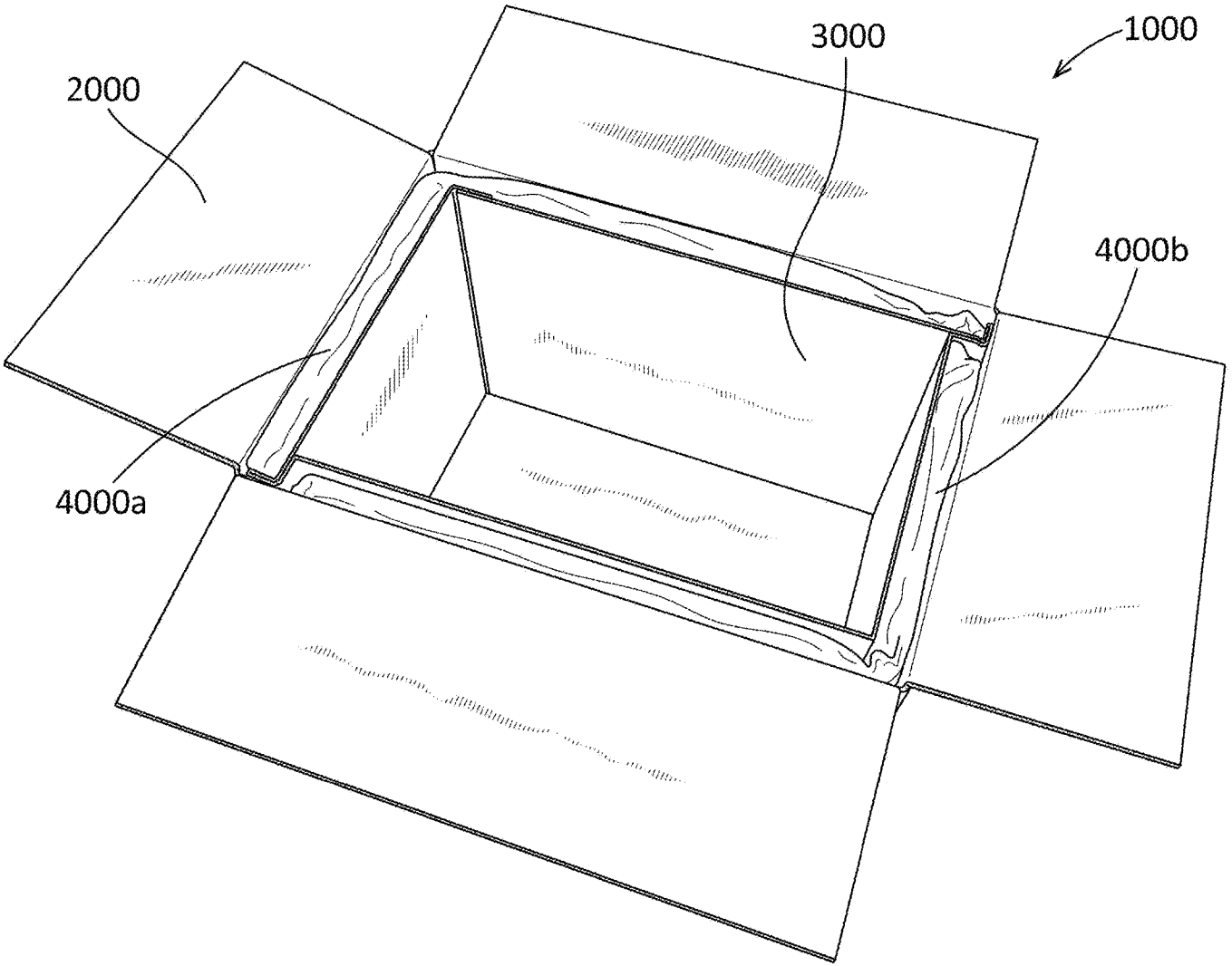
FIG. 1 is a perspective view of a packaging assembly in accord with one aspect of the current disclose.

One embodiment of a packaging assembly 1000 is disclosed and described with refence to FIG. 1. The packaging assembly 1000 can comprise an outer box 2000. The packaging assembly 1000 can comprise an insert 3000. The packaging assembly 1000 can comprise at least one insulation element 4000*a*,4000*b*. In various aspects, features and elements can be modified as would be understood by one of ordinary skill in the art. No particular configuration, element, or aspect of the disclosed packaging assembly 1000 should be considered limiting on the scope of any claims issuing therefrom.

Figure 2:
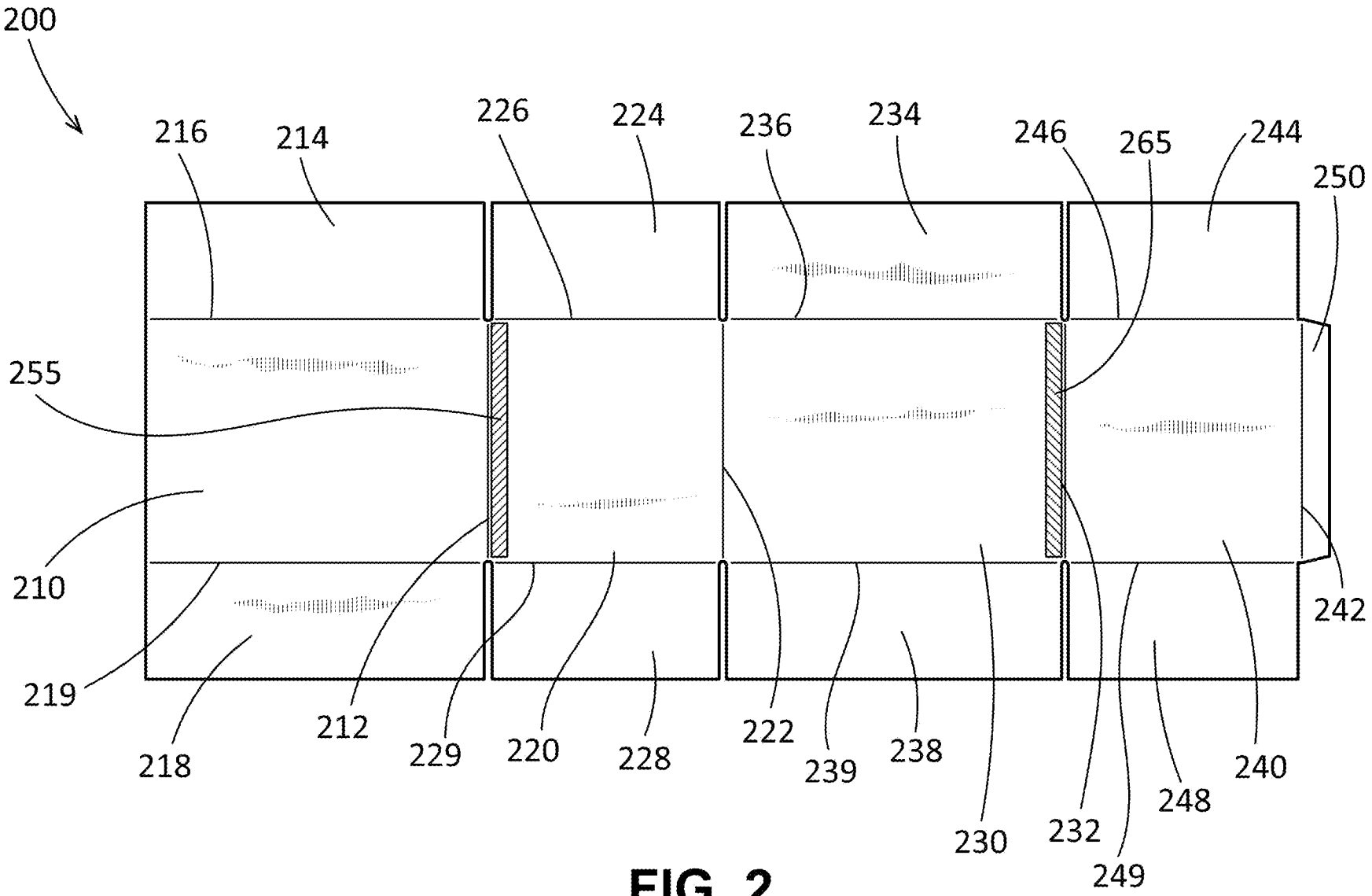
FIG. 2 is a plan view of a blank formable into an outer box of the packaging assembly of FIG. 1.

A blank 200 that can be formed into the outer box 2000 can be seen with reference to FIG. 2. The blank 200 can comprise a first main panel 210, a second main panel 220, a third main panel 230, and a fourth main panel 240. The first main panel 210 can be connected to the second main panel 220 by a line 212. In various aspects, the current disclosure references "lines." In various aspects, a "line" or a plurality of "lines" can refer to bends, perforations, cuts, creases, or combinations of bends, cuts, perforations, and creases. In various aspects, perforations can be ⅜ inches; in various aspects, perforations can be ¼ inches; in various aspects, cuts can be ½ inches; in various aspects, perforations and cuts can be of variant sizes. If not specified in the disclosure, one of skill in the art would understand that various lines described herein can be interchangeable between various aspects of the current disclosure, and one of skill in the art would not understand any particular embodiment of "line" or "lines" to be limiting on the scope of the disclosure. The second main panel 220 can be connected to the third main panel 230 by a line 222. The third main panel 230 can be connected to the fourth main panel 240 by a line 232. The fourth main panel 240 can be connected to a connection panel 250 by a line 242. The connection panel 250 can be arranged to be secured to the first main panel 210 via glue, adhesive, welding, mechanical interlocking, or various other methods of affixing elements.

A first top panel 214 can be connected to the first main panel 210 by a line 216. A second top panel 224 can be connected to the second main panel 220 by a line 226. A third top panel 234 can be connected to the third main panel 230 by a line 236. A fourth top panel 244 can be connected to the fourth main panel 240 by a line 246.

A first bottom panel 218 can be connected to the first main panel 210 by a line 219. A second bottom panel 228 can be connected to the second main panel 220 by a line 229. A third bottom panel 238 can be connected to the third main panel 230 be a line 239. A fourth bottom panel 248 can be connected to the fourth main panel 240 by a line 249.

A glue pad 255 can be arranged on the second main panel 220 proximate the line 212. A glue pad 265 can be arranged on the third main panel 230 proximate the line 232. Each glue pad 255,265 can be a pad of glue or other adhesive in various aspects. Each glue pad 255,265 can be a location for affixing apparatus as discussed in depth below. In various aspects, various connection means-including those not requiring glue-can be used in various configurations. In various aspects, glue pads 255,265 can be obviated by other methods of connection.

Figure 3:
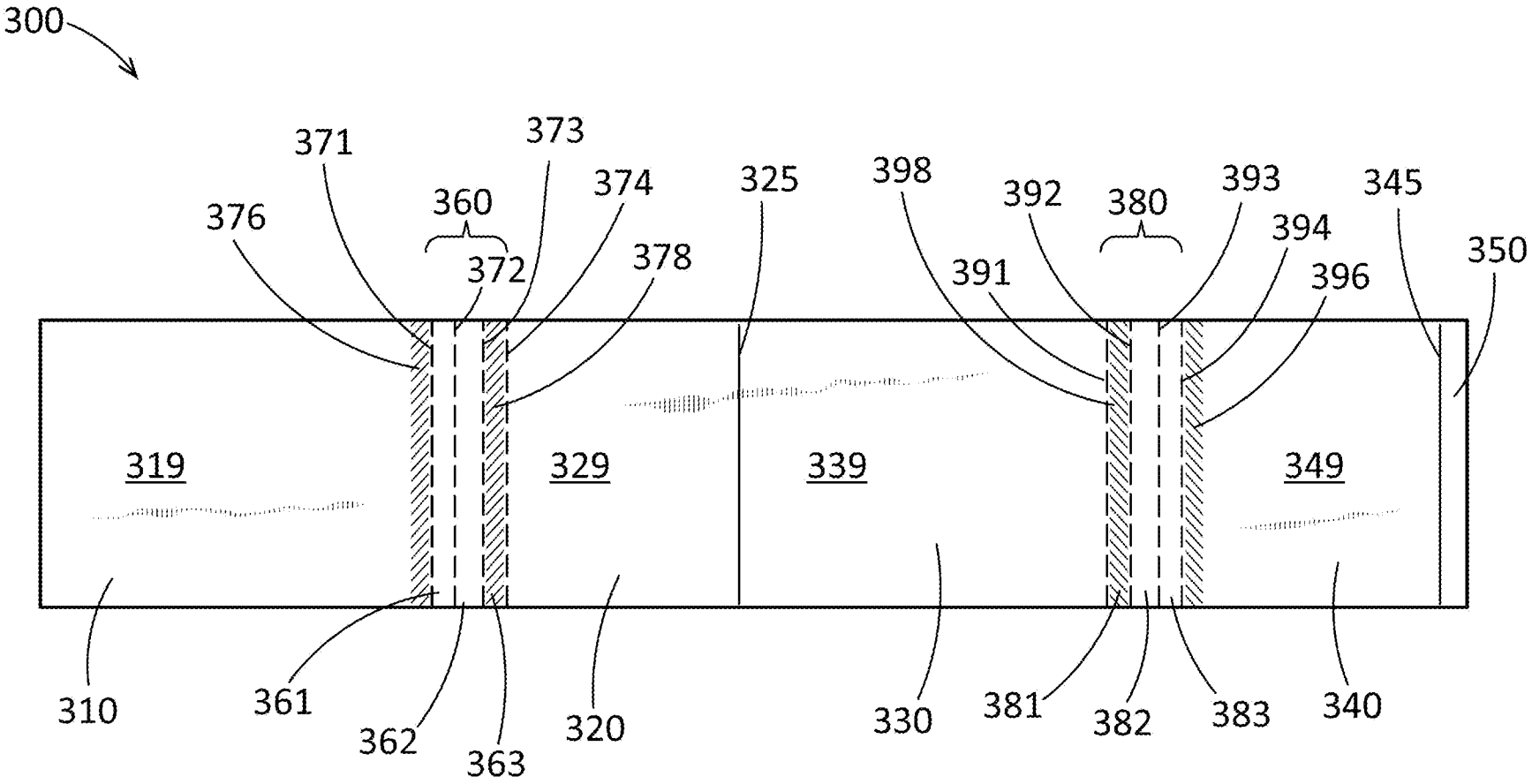
FIG. 3 is a plan view of a blank formable into an insert of the packaging assembly of FIG. 1.

A blank 300 formable into the insert 3000 can be seen with reference to FIG. 3. The blank 300 can comprise a first main panel 310, a second main panel 320, a third main panel 330, and a fourth main panel 340. A connection panel 350 can be connected to the fourth main panel 340 by a line 345. The second main panel 320 can be connected to the third main panel 330 by a line 325. A support formation 360 can be arranged between and connected to the first main panel 310 and the second main panel 320. Similarly, a support formation 380 can be arranged between and connected to the third main panel 330 and the fourth main panel 340. Each support formation can comprise additional panels.

The support formation 360 can comprise a first support panel 361, a second support panel 362, and a third support panel 363. The first support panel 361 can be connected to the first main panel 310 by a line 371. The first support panel 361 can be connected to the second support panel 362 by a line 372. The second support panel 362 can be connected to the third support panel 363 by a line 373. The third support panel 363 can be connected to the second main panel 320 by a line 374. A glue pad 376 can be arranged on the first main panel 310 proximate the support formation 360. A glue pad 378 can be arranged on the third support panel 363.

The support formation 380 can comprise a first support panel 381, a second support panel 382, and a third support panel 383. The first support panel 381 can be connected to the third main panel 330 by a line 391. The first support panel 381 can be connected to the second support panel 382 by a line 392. The second support panel 382 can be connected to the third support panel 383 by a line 393. The third support panel 383 can be connected to the fourth main panel 340 by a line 394. A glue pad 396 can be arranged on the fourth main panel 340 proximate the support formation 380. A glue pad 398 can be arranged on the first support panel 381.

An inner surface 319 of the first main panel 310 can be seen. An inner surface 329 of the second main panel 320 can be seen. An inner surface 339 of the third main panel 330 can be seen. An inner surface 349 of the fourth main panel 340 can be seen.

Figure 4:
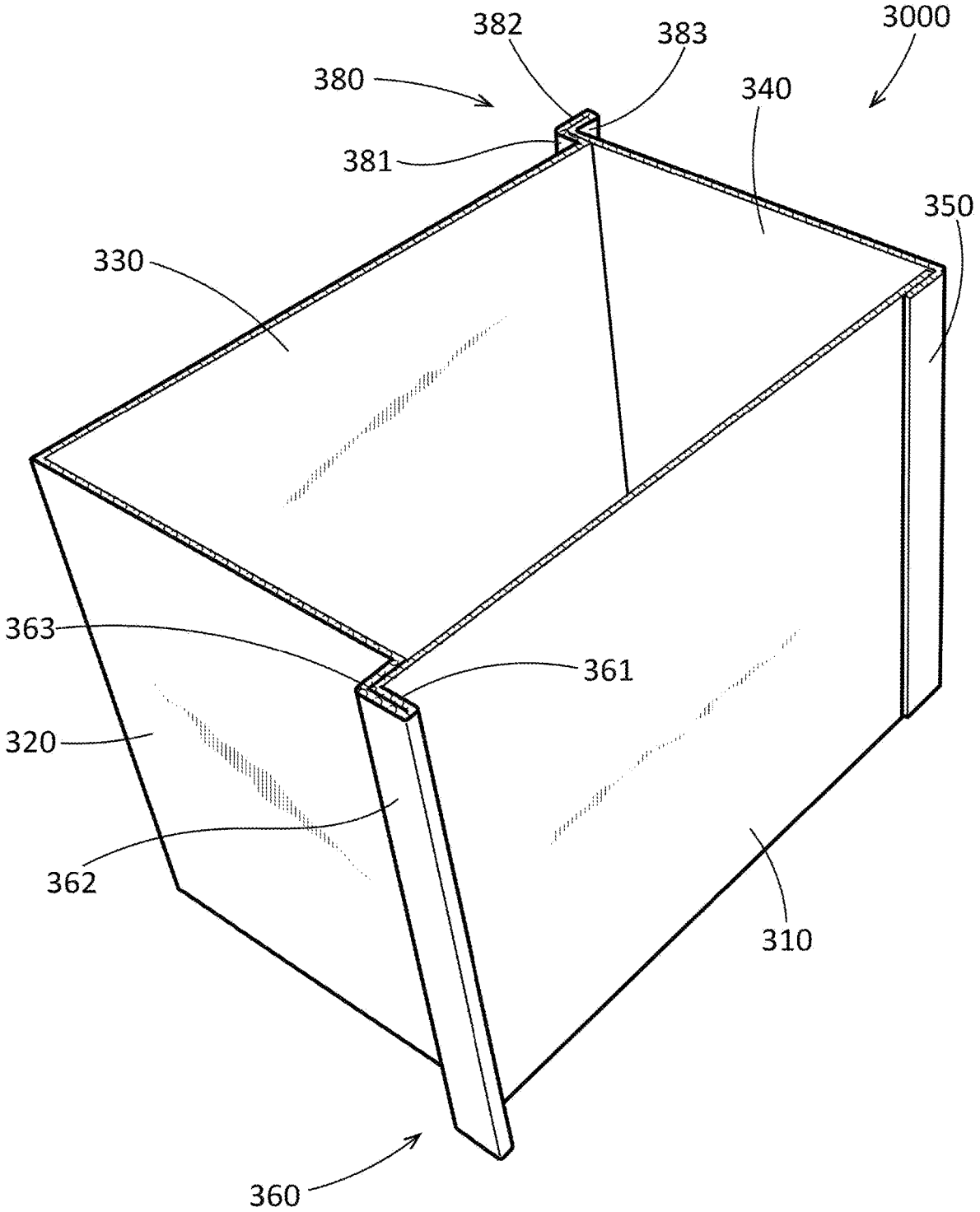
FIG. 4 is a perspective view of the insert formed form the blank of FIG. 3.

An isolated view of the insert 3000 formed from the blank 300 can be seen with reference to FIG. 4. As can be seen, the connection panel 350 can be joined to the first main panel 310 by gluing, adhering, mechanically joining, or otherwise affixing the connection panel 350 to the first main panel 310. In the current aspect, the connection panel 350 can be seen connected to an outer side of the first main panel 310. In various aspects, the connection panel 350 can be connected to various portions or surfaces of the first main panel 310.

The support formation 360 can be seen with the various elements in facing arranging. The first support panel 361 can be seen in facing contact with the second support panel 362. The third support panel 363 can be seen in facing contact with the first main panel 310. In the current aspect, the glue pad 376 can be arranged in contact with the glue pad 378 and can allow the support formation 360 to maintain its shape. The support formation 380 can be seen with the various elements in facing arranging. The second support panel 382 can be seen in facing contact with the third support panel 383. The first support panel 381 can be seen in facing contact with the fourth main panel 340. In the current aspect, the glue pad 396 can be arranged in contact with the glue pad 398 and can allow the support formation 380 to maintain its shape.

Figure 5A:
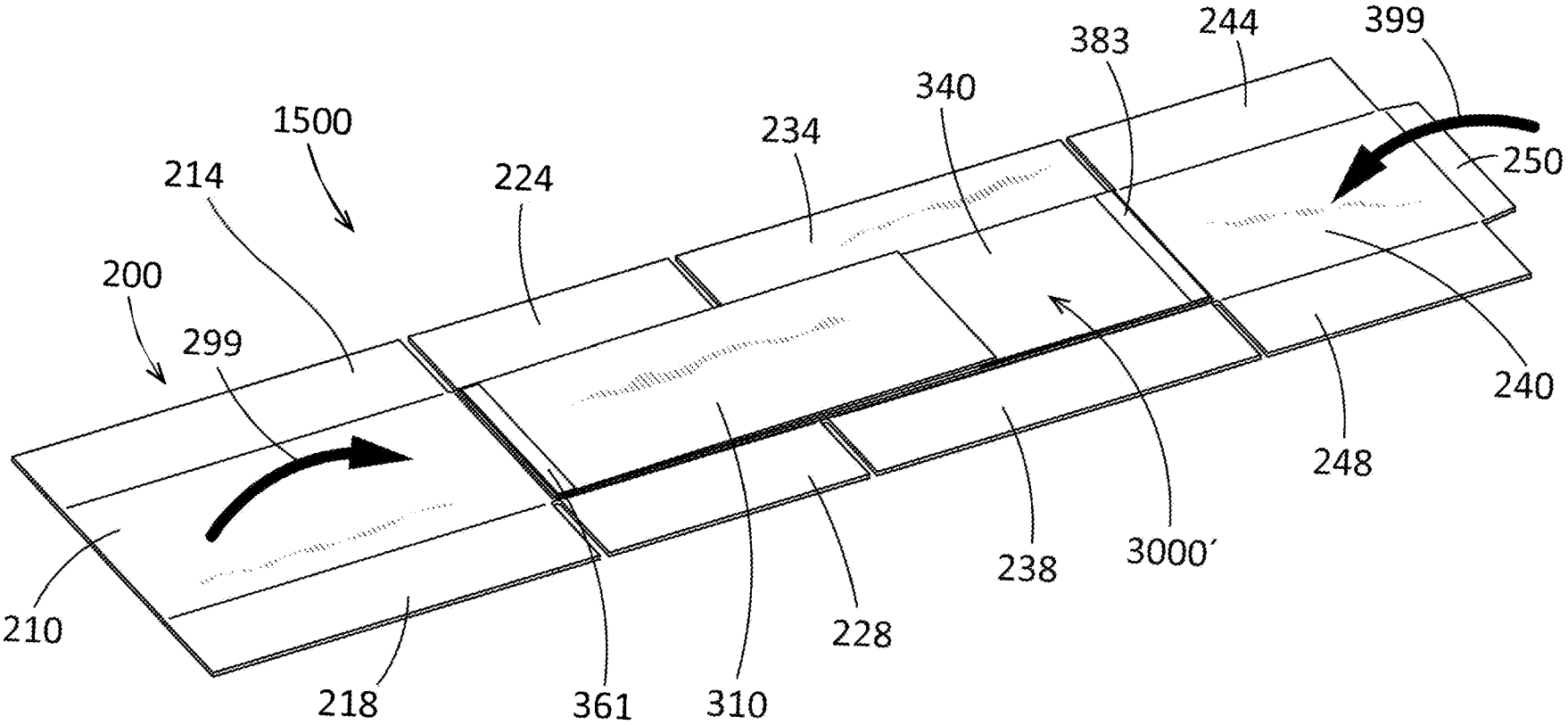
FIG. 5A is a perspective view of a packaging subassembly formable into the packing assembly of FIG. 1 in a collapsed state.
Figure 5B:
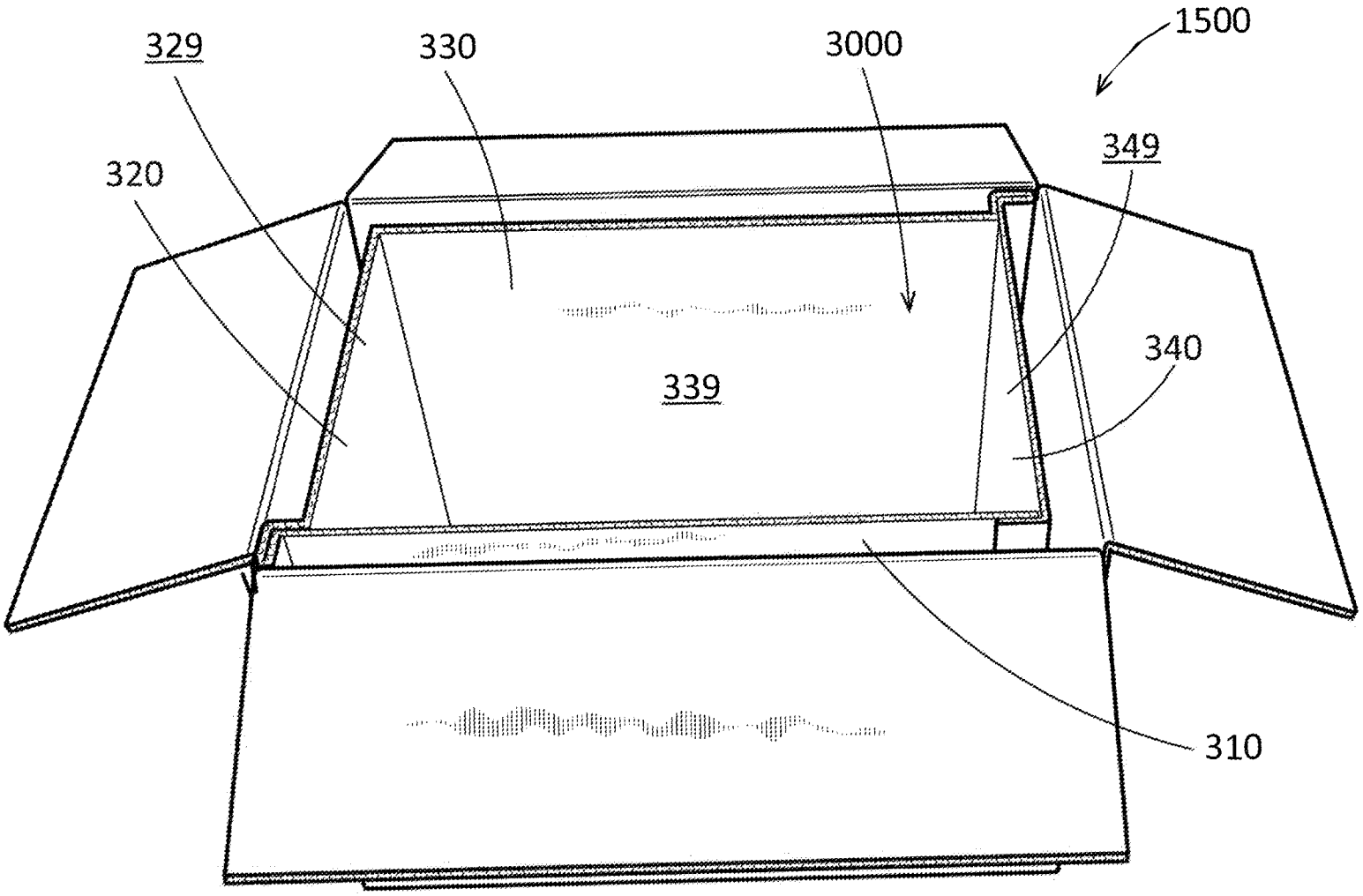
FIG. 5B is a perspective view of the packaging subassembly of FIG. 5A formed into an expanded state.

A packaging subassembly 1500 can be seen with reference to FIGS. 5A-5B. With specific reference to FIG. 5A, a collapsed insert 3000' can be a collapsed version of the insert 3000 and can be arranged on the blank 200 formable into the box 2000. The collapsed insert 3000' can be assembled from the blank 300 and can be arranged with the first main panel 310, second main panel 340, first support panel 361, and third support panel 383 in co-planar arrangement. In the current aspect, the first main panel 310 can be in contact with and mainly facing the second main panel 320 (not visible in the view of FIG. 5A) and the fourth main panel 340 can be in contact with and mainly facing the third main panel 330 (not visible in the view of FIG. 5A). Similarly, the collapsed insert 3000' can be arranged with the second main panel 320, the third main panel 330, the second support panel 362, the third support panel 363, the first support panel 381, and the second support panel 382 in co-planar arrangement (all features not visible in the view of FIG. 5A). The blank 300 can be sized such that the collapsed insert 3000' can fit within the space that would be occupied by the second main panel 220 and the third main panel 230. The second support panel 362 can be arranged to be in contact with the glue pad 255. The second support panel 382 can be arranged to be in contact with the glue pad 265. As such, the collapsed insert 3000' can be affixed to the blank 200 as part of the packaging subassembly 1500.

Motion 299,399 can be shown as the folding of the blank 200 to form the outer box 2000 by securing the connection panel 250 to the first main panel 210. Upon folding and adhering the connection panel 250 to the first main panel 210, the insert 3000 can be formed from the collapsed insert 3000' and the outer box 2000 can be formed from the blank 200. As such, one manufacturing action can modify the packaging subassembly 1500 from a flattened state or collapsed state shown with reference to FIG. 5A to an expanded state or assembled state shown with reference to FIG. 5B. Additionally, the insert 3000 and blank 200 forming the packaging subassembly 1500 can be shipped in the flattened state of FIG. 5A and can be stacked with additional packaging subassemblies 1500 to allow efficient delivery of the packaging subassemblies 1500 and efficient assembly of each packaging subassembly 1500 from the collapsed state to the expanded state.

In the current aspect, various features and parts of the packaging assembly 1000 can be formed of various paper products, including paperboard, corrugated cardboard, kraft paper, and various other materials. In various aspects, the blanks 200,300 can be formed of varying materials including various plastics, metals, wood, or various other elements. In various aspects, the blanks 200,300 can be a combination of materials described herein or known within the relevant art. In various aspects, the packaging of the current disclosure can be formed without the use of a blank such as the blanks 200,300. One of skill in the art would understand that use of the blanks 200,300 is but one method of assembling the packaging of the current disclosure.

In the current aspect, various surfaces can be covered by a temperature-preserving lining. In various aspects, the temperature-preserving lining can be a product adhered to a surface of the blanks 200,300. In various aspects, the temperature-preserving lining can be a film adhered to the surface of one of the blanks 200,300. Films can be adhered to surfaces through various methods, including adhesion (such as with glues or chemical adhesives) or by deposition (such as by vapor deposition) among other methods. In various aspects, the film temperature-preserving lining can be a highly reflective coating. Such a highly reflective surface can be of low emissivity, thereby serving as an effective insulating material. Examples of coatings or films that can be used for temperature-preserving linings can be found with reference to United States Patent Application of Sollie, filed Jul. 14, 2023, bearing application Ser. No. 18/222,272, which is incorporated by reference herein in its entirety. In various aspects, the blanks 200,300 can include the temperature-preserving lining on all sides. In various aspects, the blanks 200,300 can include the temperature-preserving lining on only one side to reduce costs. In various aspects, temperature-preserving lining can be omitted.

The inner surfaces 319,329,339,349 can together form an inner surface of the insert 3000. In particular, temperature-preserving lining can be adhered to the inner surface of the insert 3000. With reference to FIG. 5B, inner surfaces 329,339,349 of the main panels 320,330,340, respectively, can be seen.

Figure 6:
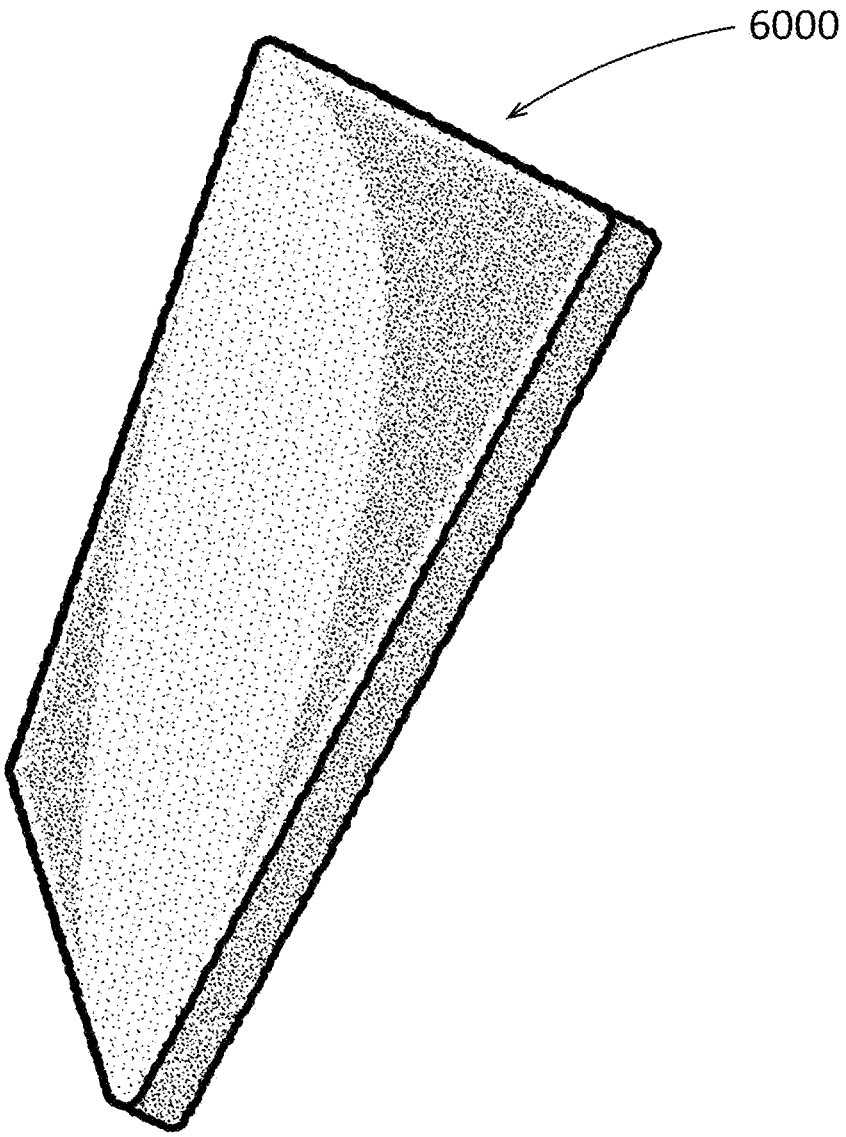
FIG. 6 is a perspective view of a bottom insulation pad for use with the packaging assembly of FIG. 1.

A bottom insulation pad 6000 can be seen with reference to FIG. 6. The bottom insulation pad 6000 can be sized to fit within the insert 3000 along a bottom of the outer box 2000. The bottom insulation pad 6000 can be an insulating pad, batt, or otherwise insulating material. In the current aspect, each insulator can be a physical object of insulting capacity such as an insulating pad, an air-filled bag, added cardboard, added paper product, paper fill, or various other insulation. In the current aspect, the bottom insulation pad 6000 can be representative of all different forms of insulation utilized with the packaging assembly 1000. The bottom insulation pad 6000 can be an insulation batt on its own. The bottom insulation pad 6000 can be an insulation batt encapsulated within a paper capsule. The paper capsule can be a first paper layer secured to a second paper layer and sealed around a perimeter of the insulation batt to encapsulate the insulation batt. In various aspects, the insulation batt can be repulpable. Further description of aspects of some insulators that can be used in the packaging assembly 1000 can be found with reference to the following United States Patents and Applications for United States Patent, which are incorporated by reference herein in their entirety: U.S. patent application Ser. No. 17/834,999, filed Jun. 8, 2022, (issued as U.S. Pat. No. 11,780,666 on Oct. 10, 2023); U.S. patent application Ser. No. 17/502,599, filed Oct. 15, 2021 (issued as U.S. Pat. No. 11,634,265 on Apr. 25, 2023); U.S. patent application Ser. No. 17/123,673, filed Dec. 16, 2020 (issued as U.S. Pat. No. 11,214,427 on Jan. 4, 2022); U.S. patent application Ser. No. 16/414,309, filed May 16, 2019 (issued as U.S. Pat. No. 10,882,682 on Jan. 5, 2021); U.S. patent application Ser. No. 15/677,738, filed Aug. 15, 2017 (issued as U.S. Pat. No. 10,583,977 on Mar. 10, 2020); U.S. Provisional Application Nos. 62/375,555, filed on Aug. 16, 2016; 62/419,894, filed on Nov. 9, 2016; and, 62/437,365, filed on Dec. 21, 2016.

Figure 7:
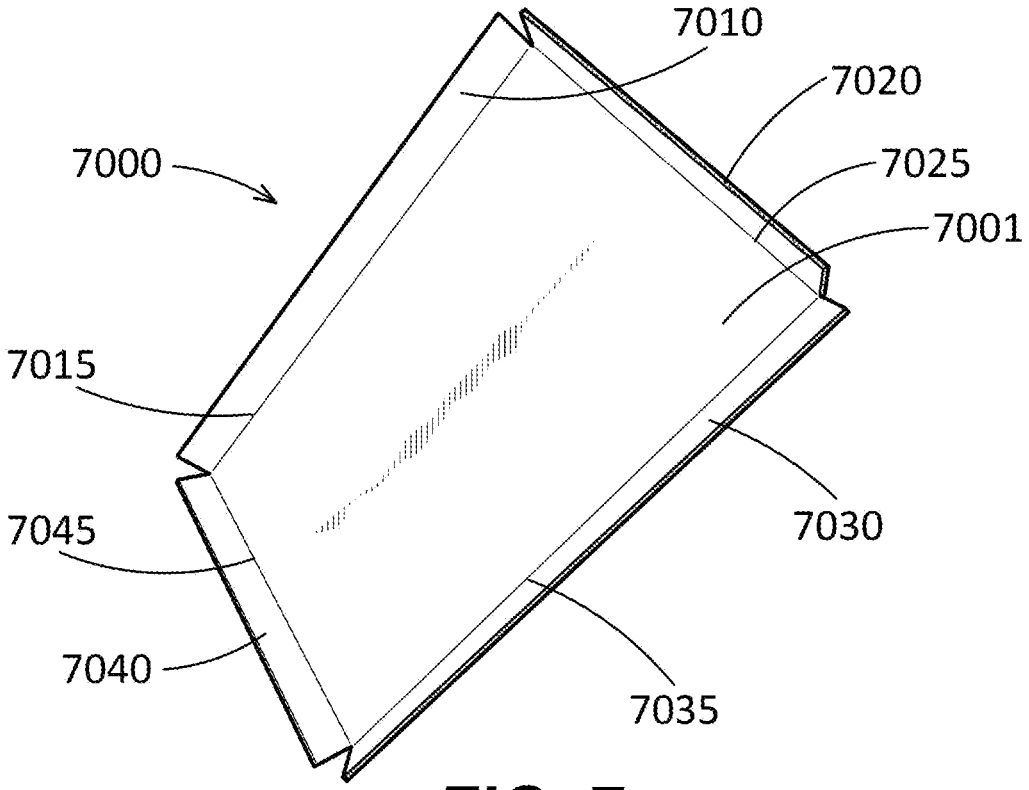
FIG. 7 is a perspective view of a bottom insulation cover for use with the packaging assembly of FIG. 1.

A bottom insulation cover 7000 as can be utilized in various aspects of the current disclosure can be seen with reference to FIG. 7. The bottom insulation cover 7000 can comprise a main panel 7001; a first side panel 7010 connected to the main panel 7001 by a line 7015; a second side panel 7020 connected to the main panel 7001 by a line 7025; a third side panel 7030 connected to the main panel 7001 by a line 7035; and, a fourth side panel 7040 connected to the main panel 7001 by a line 7045. The side panels 7010,7020, 7030,7040 can be arranged to surround the bottom insulation pad 6000 and the main panel 7001 can be arranged to provide a barrier between the bottom insulation pad 6000 and any contents to be placed within the packaging assembly 1000.

Figure 8:
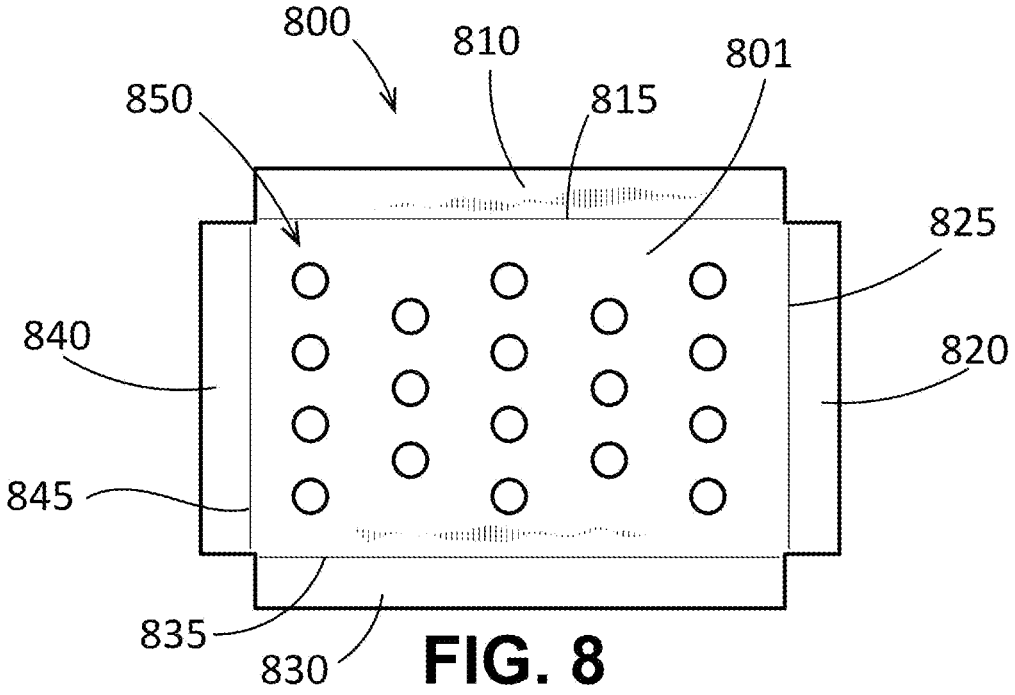
FIG. 8 is a plan view of a blank formable into a vented cover for use with the packaging assembly of FIG. 1.

A blank 800 for forming a vented cover (not seen in the current view) can be seen with reference to FIG. 8. The blank 800 can comprise a main panel 801; a first end panel 810 connected to the main panel 801 by a line 815; a second end panel 820 connected to the main panel 801 by a line 825; a third end panel 830 connected to the main panel 801 by a line 835; and, a fourth end panel 840 connected to the main panel 801 by a line 845. The main panel 801 can define a plurality of vents 850. In the current aspect, eighteen vents 850 of circular cross-section can be defined in the main panel 801. In the current aspect, each vent 850 is of about circular cross-section. In various aspects, vents 850 can be of different shapes and sizes. In various aspects, vents 850 can be omitted from the design of the current disclosure. In assembly, the blank 800 can be formed to fit within the insert 3000 and provide a physical barrier between the contents of the packaging assembly 1000 and any environment outside of the packaging assembly 1000.

Figure 9A:
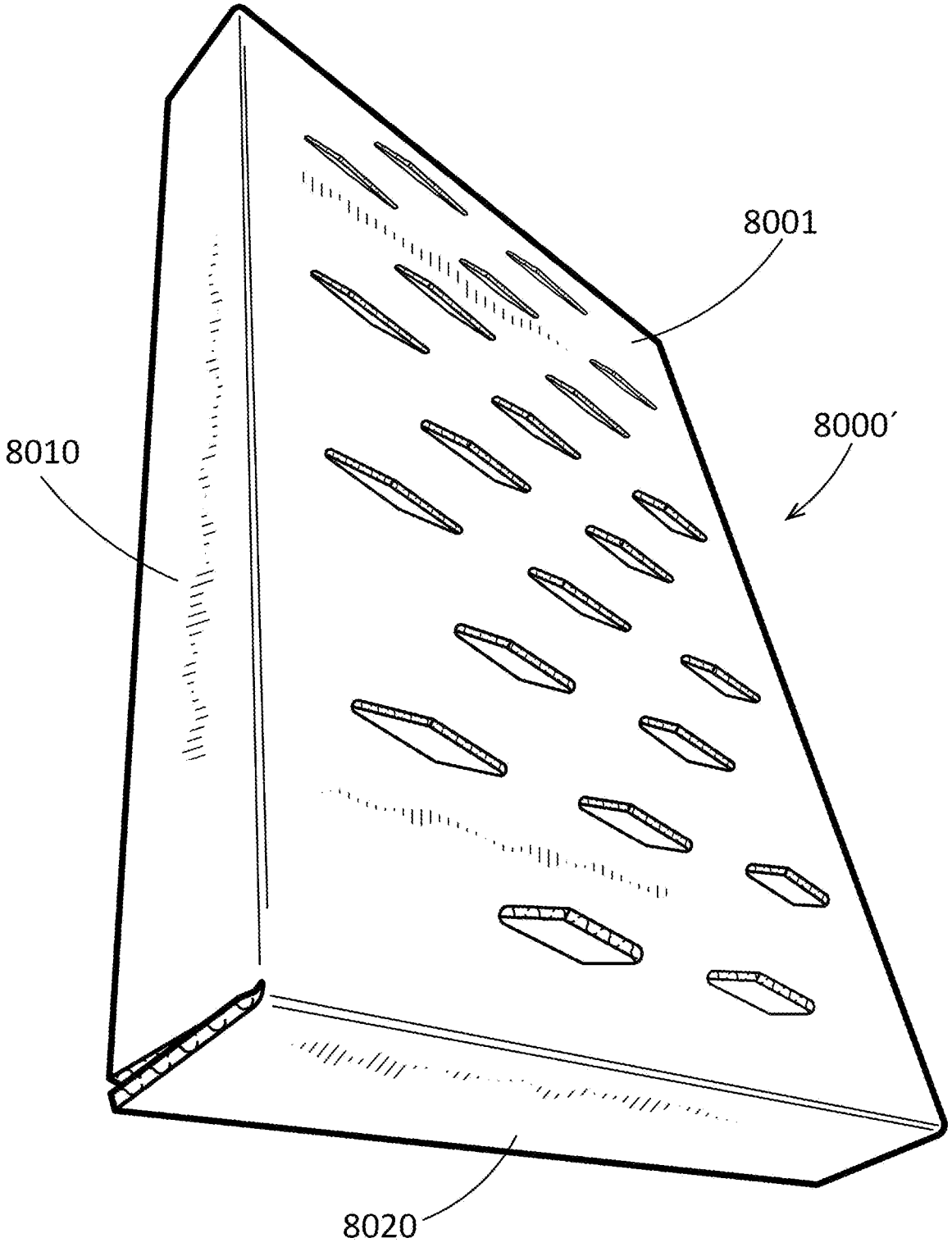
FIG. 9A is a perspective view of a vented cover with the packaging assembly of FIG. 1.
Figure 9B:
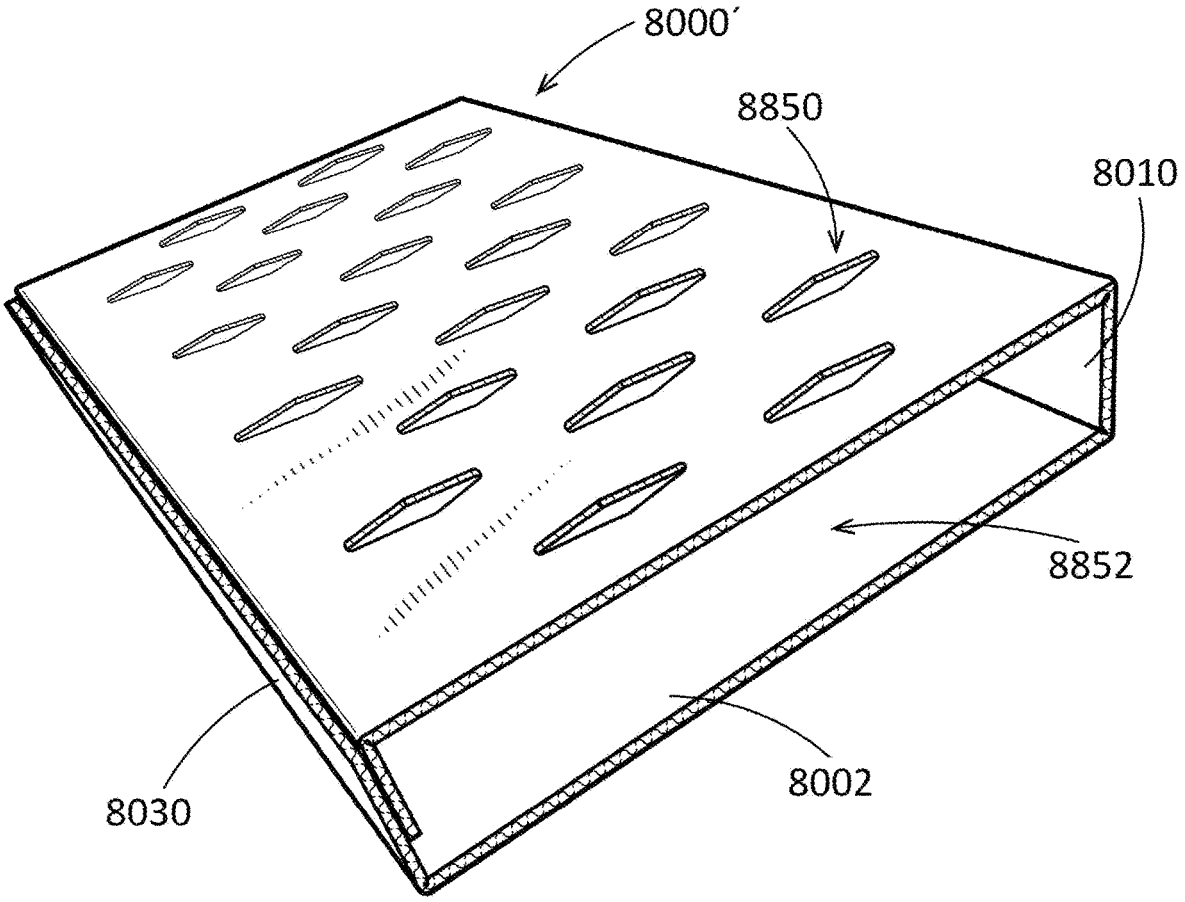
FIG. 9B is another perspective view of the vented cover of FIG. 9A.

Another aspect of a vented cover 8000' can be seen with reference to FIGS. 9A-9B. The vented cover 8000' can comprise a top 8001, a first side 8010, a second side 8020, a third side 8030, and a bottom 8002. In various aspects, a fourth side can be included. In the current aspect, a fourth side can be omitted. Similarly to the blank 800, the top 8001 can define a plurality of vents 8850. In the current aspects, each vent 8850 can be an oblong shape and defined in the top 8001. In the current aspect, twenty-two vents 8850 can be defined in the top 8001. The various features of the vented cover 8000' can be arranged to define a gap 8852 between the top 8001, the first side 8010, the second side 8020, the third side 8030, and the bottom 8002. Top vented cover 8000' can be inserted in the packaging assembly 1000 within the insert 3000 to provide an insulated top end to the packaging assembly 1000. In various aspects, the vented cover 8000' can contain an insulation material or insulated pad similar to the bottom insulation pad 6000 within the gap 8852.

Figure 10A:
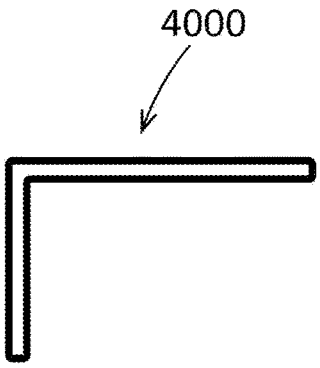
FIG. 10A is side view of an insulation element of the packaging assembly of FIG. 1.
Figure 10B:
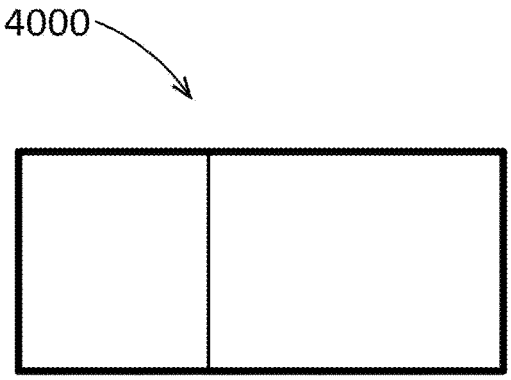
FIG. 10B is a side view of the insulation element of FIG. 10A.

An insulation element 4000 or insulation pad can be seen with reference to FIGS. 10A-10B. Each insulation element 4000 can be an insulating material similar to bottom insulation pad 6000, described above. In various aspects, the insulation element 4000 can be various materials similar to bottom insulation pad 6000. In various aspects, each insulation element 4000 can be an insulation batt surrounded by kraft paper as previously described. Each insulation element 4000*a*,4000*b* described with brief reference to FIG. 1 can be an insulation element 4000. Each insulation element 4000 can be sized to fit within a space defined between the outer box 2000 and the insert 3000. In various aspects, each insulation element 4000 can be rectangular with a bend located at a point somewhere within the insulation element 4000 allowing each insulation element 4000 to accommodate the shape of the box 2000 and the insert 3000.

Figure 11A:
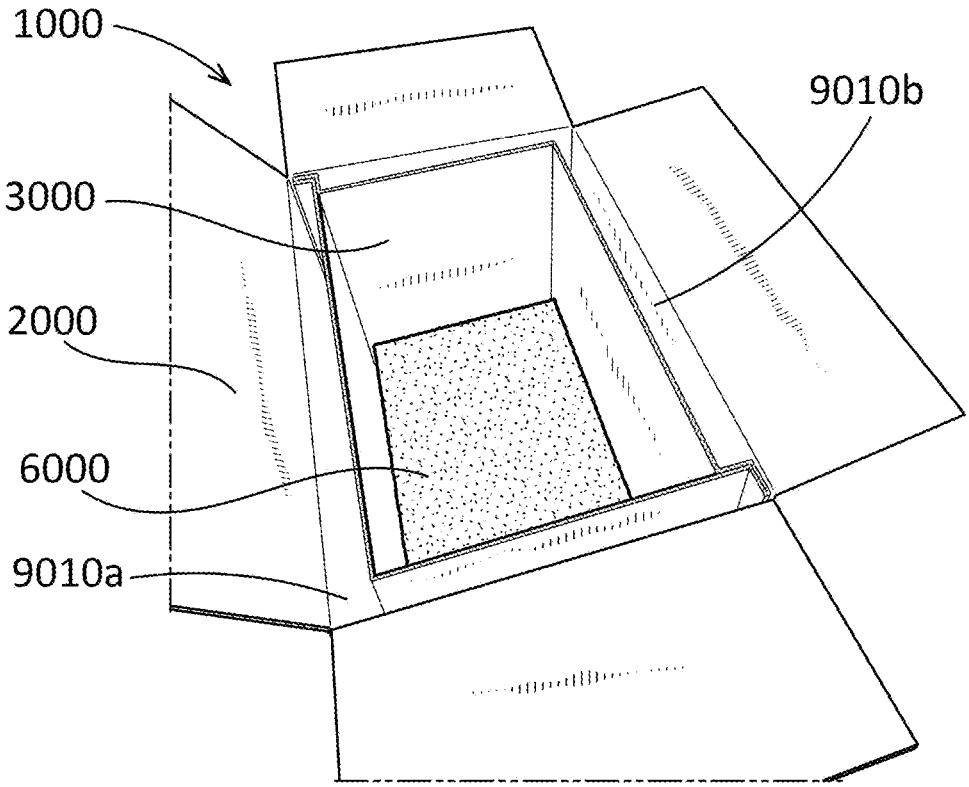
FIG. 11A is a perspective view of the packaging assembly of FIG. 1 including the bottom insulation pad of FIG. 6.
Figure 11B:
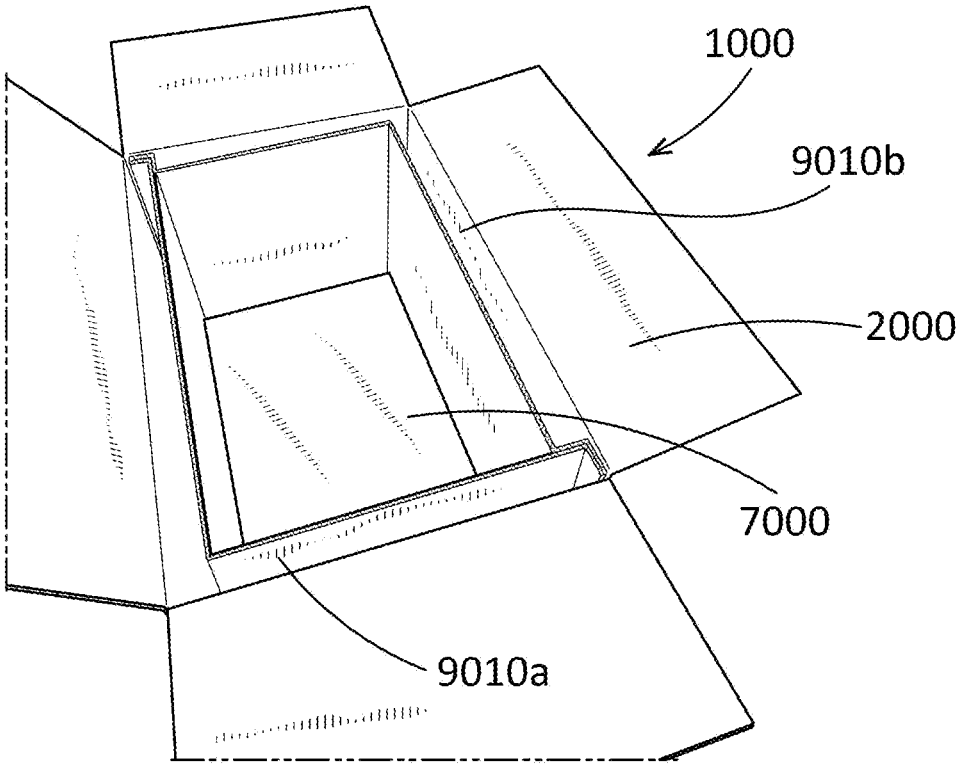
FIG. 11B is a perspective view of the packaging assembly of FIG. 1 including the bottom insulation cover of FIG. 7.
Figure 11C:
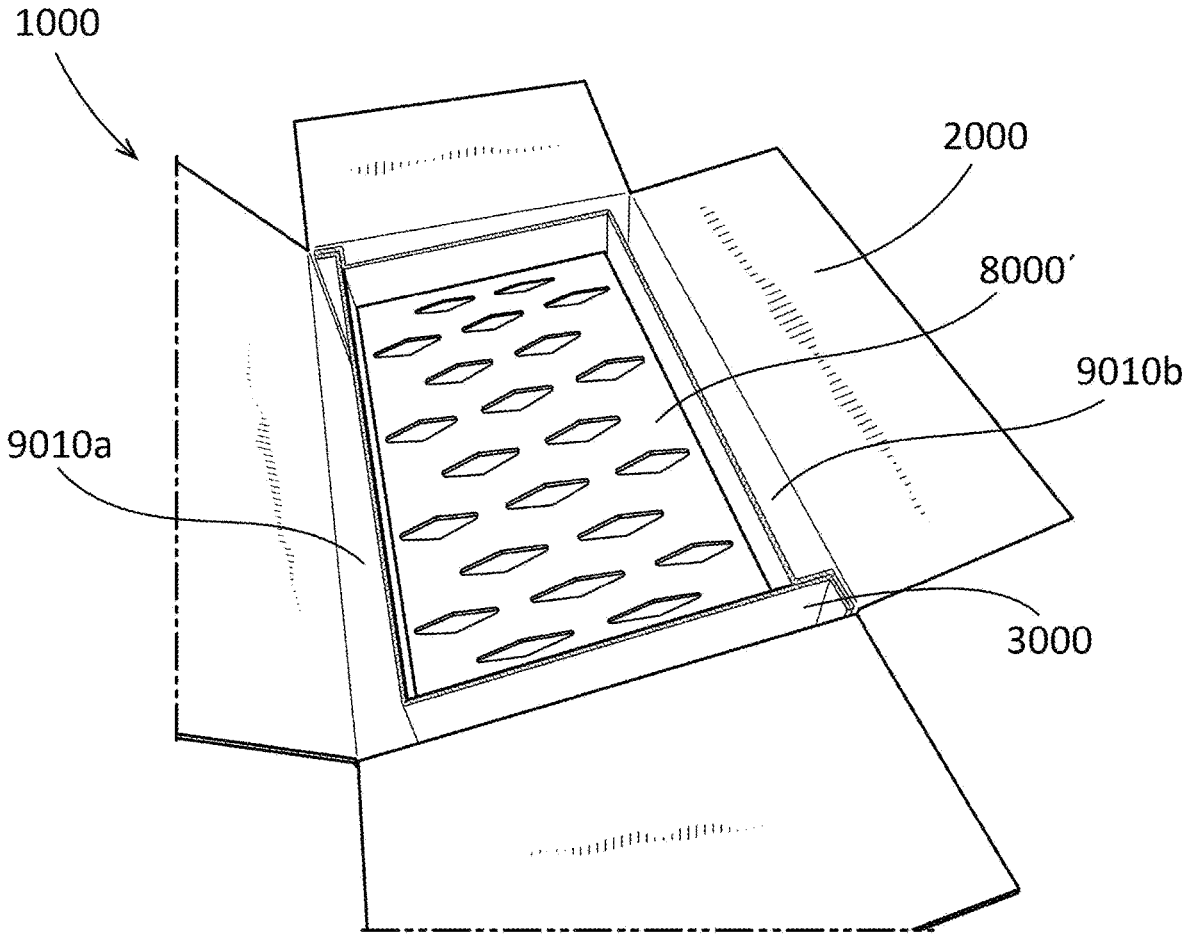
FIG. 11C is a perspective view of the packaging assembly of FIG. 1 including the vented cover of FIGS. 9A-9B.

Various aspects of the packaging assembly 1000 can be seen with reference to FIGS. 11A-11C. With specific reference to FIG. 11A, the bottom insulation pad 6000 can be seen inserted within and arranged inside the insert 3000 within the outer box 2000. With reference to FIG. 11B, the bottom insulation cover 7000 can be seen arranged over the bottom insulation pad 6000 inside the insert 3000 within the outer box 2000. With specific reference to FIG. 11C, the vented cover 8000' can be seen arranged within the insert 3000 within the outer box 2000. Gaps 9010*a*, 9010*b* can be defined between the insert 3000 and the outer box 2000. In various aspects, the gaps 9010*a*,9010*b* can be left empty. As seen with reference to FIG. 1, the caps 9010*a*,9010*b* can be filled with insulation pads 4000*a*,4000*b*. in various aspects, various features can be utilized with gaps 9010*a*,9010*b*.

In various aspects, various features can be included and omitted as would be understood to one of skill in the art. One of skill in the art would understand the various features and elements described here can be interchangeably moved between various aspects without departing from the scope of the current disclosure. No single aspect should be considered limiting on the scope of this disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A packaging assembly comprising:

an outer box, the outer box comprising a first main panel connected to a second main panel, a third main panel connected to the second main panel, and a fourth main panel connected to the third main panel, the fourth main panel connected to the first main panel;

an insert connected to at least two of the main panels of the outer box, the insert comprising a first main panel connected to a second main panel;

a third main panel connected to the second main panel; and a fourth main panel connected to the first main panel and the third main panel, wherein at least one support formation folds from at least two of the four main panels of the insert, wherein each support formation comprises a first support panel, a second support panel connected to the first support panel at a first bend line, and a third support panel connected to the second support panel at a second bend line;

the first support panel is in facing contact with the second support panel;

each support formation connects the insert to the outer box; and the insert is folded from a blank;

wherein a continuous gap is defined between two adjacent main panels of the insert and two corresponding adjacent main panels of the outer box.

2. The packaging assembly of claim 1, wherein the insert is arranged within the outer box.

3. The packaging assembly of claim 2, wherein at least one gap is defined between the insert and the outer box.

4. The packaging assembly of claim 3, wherein an insulation pad is arranged within each gap.

5. The packaging assembly of claim 4, wherein two gaps are defined between the insert and the outer box.

6. The packaging assembly of claim 2, further comprising a bottom insulation pad arranged within the insert.

7. The packaging assembly of claim 6, further comprising a bottom insulation cover in contact with the bottom insulation pad.

8. The packaging assembly of claim 2, further comprising a vented cover arranged within the insert.

9. The packaging assembly of claim 1, wherein the insert is connected to the second main panel and the third main panel of the outer box.

10. The packaging assembly of claim 9, wherein each connection of the insert to the outer box is by a glue pad.

11. The packaging assembly of claim 1, wherein an inner surface of the insert is coated with a temperature-preserving lining.

12. The packaging assembly of claim 1, wherein the first main panel of the insert, the second main panel of the insert, the third main panel of the insert, and the fourth main panel of the insert define a cavity.

13. The packaging assembly of claim 1, wherein each support formation is connected to two of the four main panels of the outer box at the first bend line of the support formation and the second bend line of the support formation.

14. The packaging assembly of claim 13, wherein the first bend line of the support formation and the second bend line of the support formation are scored on the blank.

15. A packaging assembly comprising:

an outer box, the outer box comprising a first main panel connected to a second main panel, a third main panel connected to the second main panel, and a fourth main panel connected to the third main panel, the fourth main panel connected to the first main panel;

an insert arranged within the outer box and defining at least one gap between the insert and the outer box, the insert comprising a first main panel connected to a second main panel;

a third main panel connected to the second main panel; and a fourth main panel connected to the first main panel and the third main panel, wherein at least one support formation folds from at least two of the four main panels of the insert;

wherein each support formation comprises a first support panel, a second support panel connected to the first support panel at a first bend line, and a third support panel connected to the second support panel at a second bend line;

each support formation connects the insert to the outer box; and the insert is folded from a blank;

wherein a continuous gap is defined between two adjacent main panels of the insert and two corresponding adjacent main panels of the outer box.

16. The packaging assembly of claim 15, wherein each gap is filled with an insulation element.

17. The packaging assembly of claim 15, wherein at least one first support panel is in facing contact with one second support panel.

18. The packaging assembly of claim 15, wherein at least one support formation comprises a glue pad connecting at least one support panel to at least one other support panel.

19. The packaging assembly of claim 15, wherein the insert is connected to the second main panel and the third main panel of the outer box.

20. The packaging assembly of claim 19, wherein each connection of the insert to the outer box is by a glue pad.

21. The packaging assembly of claim 15, wherein each support formation is connected to two of the four main panels of the outer box at the first bend line of the support formation and the second bend line of the support formation.

22. The packaging assembly of claim 21, wherein the first bend line of the support formation and the second bend line of the support formation are scored on the blank.

23. The packaging assembly of claim 15, wherein the first main panel of the insert, the second main panel of the insert, the third main panel of the insert, and the fourth main panel of the insert define a cavity.

* * * * *